US010428410B2

(12) United States Patent
Garrison, Jr.

(10) Patent No.: US 10,428,410 B2
(45) Date of Patent: Oct. 1, 2019

(54) HIGH TOUGHNESS SECONDARY HARDENING STEELS WITH NICKEL AS A PRIMARY STRENGTH AND TOUGHENING AGENT

(71) Applicant: Carnegie Mellon University, Pittsburgh, PA (US)

(72) Inventor: Warren M. Garrison, Jr., Pittsburgh, PA (US)

(73) Assignee: Carnegie Mellon University, Pittsburgh, PA (US)

( * ) Notice: Subject to any disclaimer, the term of this patent is extended or adjusted under 35 U.S.C. 154(b) by 561 days.

(21) Appl. No.: 15/136,205

(22) Filed: Apr. 22, 2016

(65) Prior Publication Data

US 2016/0237535 A1 Aug. 18, 2016

Related U.S. Application Data

(63) Continuation-in-part of application No. 13/881,344, filed as application No. PCT/US2011/058044 on Oct. 27, 2011.

(60) Provisional application No. 62/178,946, filed on Apr. 23, 2015, provisional application No. 61/455,983, filed on Oct. 29, 2010.

(51) Int. Cl.

| | |
|---|---|
| ***C22C 38/46*** | (2006.01) |
| ***C22C 38/02*** | (2006.01) |
| ***C22C 38/42*** | (2006.01) |
| ***C22C 38/44*** | (2006.01) |
| ***C21B 13/12*** | (2006.01) |
| ***C21D 1/18*** | (2006.01) |

(52) U.S. Cl.

CPC ..... *C22C 38/46* (2013.01); *C21B 13/12* (2013.01); *C21D 1/18* (2013.01); *C22C 38/02* (2013.01); *C22C 38/42* (2013.01); *C22C 38/44* (2013.01); *C21D 2211/001* (2013.01)

(58) Field of Classification Search

CPC ..... C22C 38/02; C22C 38/44; C22C 38/46; C22C 38/42; C21B 13/12; C21D 1/18

USPC ..... 148/331, 335, 548

See application file for complete search history.

(56) References Cited

U.S. PATENT DOCUMENTS 5,780,165 A * 7/1998 Fukumoto ..... F16C 33/62 148/335
2009/0291014 A1 11/2009 Vartanov
2013/0228253 A1 9/2013 Garrison, Jr.

FOREIGN PATENT DOCUMENTS

| | | | |
|---|---|---|---|
| EP | 2159296 | A1 | 3/2010 |
| JP | 08-081740 | A | 3/1996 |
| JP | 2001-131634 | A | 5/2001 |

OTHER PUBLICATIONS

International Search Report and Written Opinion dated Apr. 10, 2012, issued in connection with related PCT/US2011/058044 filed Oct. 27, 2011.
W. M. Garrison, Jr., "Influence of Silicon on Strength and Toughness of 5 wt-%Cr Secondary Hardening Steel," Materials Science and Technology, vol. 3, 1987, pp. 256-259.
W. M. Garrison, Jr., "A Comparison of the Effects of Cobalt, Silicon, Nickel and Aluminum on the Tempering Response of a medium Chromiium Secondary Hardening Steel" ISIJ International, vol. 46, 2006, pp. 782-784.
Response to Restriction Requirement dated Sep. 3, 2015, in connection with U.S. Appl. No. 13/881,344, filed Apr. 24, 2013.
Response to Office Action dated Jan. 25, 2016, in connection with U.S. Appl. No. 13/881,344, filed Apr. 24, 2013.
Non-Final Office Action dated Sep. 24, 2015, in connection with U.S. Appl. No. 13/881,344, filed Apr. 24, 2013.
Restriction Requirement dated Jul. 8, 2015, in connection with U.S. Appl. No. 13/881,344, filed Apr. 24, 2013.
Notice of Allowance dated Mar. 1, 2016, in connection with U.S. Appl. No. 13/881,344, filed Apr. 24, 2013.

* cited by examiner

*Primary Examiner* — Brian D Walck
(74) *Attorney, Agent, or Firm* — Downs Rachlin Martin PLLC

(57) ABSTRACT

Steel alloys having high yield and ultimate tensile strengths in combination with high toughness based on medium carbon secondary hardening steel compositions having low cobalt content. Nickel is added to the medium carbon secondary hardening steel compositions to increase the yield and tensile strengths and fracture toughness. Applications of a steel alloy of the present disclosure include structural applications requiring high strength and high fracture toughness, such as aircraft landing gear.

14 Claims, No Drawings

HIGH TOUGHNESS SECONDARY HARDENING STEELS WITH NICKEL AS A PRIMARY STRENGTH AND TOUGHENING AGENT

RELATED APPLICATION DATA

This application is a continuation-in-part of U.S. patent application Ser. No. 13/881,344, with a 371(c) date of Apr. 24, 2013, and titled "High Toughness Secondary Hardening Steel," that is a 371 application of International Application PCT/US11/58044, filed on Oct. 27, 2011, and titled "High Toughness Secondary Hardening Steel," which claims the benefit of priority of U.S. Provisional Patent Application Ser. No. 61/455,983, filed on Oct. 29, 2010, and titled "High Toughness Secondary Hardening Steels." This application also claims the benefit of priority of U.S. Provisional Patent Application Ser. No. 62/178,946, filed on Apr. 23, 2015, and titled "Secondary Hardening Steels of Moderate Alloy Content with Nickel." Each of these applications is incorporated by reference herein in its entirety.

FIELD OF THE INVENTION

The present invention generally relates to the field of metallurgy. In particular, the present invention is directed to high toughness secondary hardening steels with nickel as a primary strength and toughening agent.

BACKGROUND

A variety of compositions and processes have been developed to form steels that can meet the demanding performance characteristics required for aircraft landing gear. Steels that are used for landing gear are generally martensitic steels, and the steels used for landing gear for commercial aircraft and for U.S. Air Force planes are low alloy steels such as 4340 and 300M. The compositions of these steels are given in Table I, below. These steels are tempered in the range of 200° C. to 300° C. and are strengthened by carbon in solid solution and the precipitation of iron carbides. They have the desired strength for landing gear but they have fairly low toughness, no corrosion resistance and low resistance to stress corrosion cracking.

About 15 years ago, the U.S. Navy started to use a new steel called AerMet 100 for the landing gear of its planes. This steel's composition is also given in Table I, below. AerMet 100 has very high strength and excellent fracture toughness and better resistance to stress corrosion cracking than 300M or 4340. However, this steel is quite expensive as it contains 13.4 wt. % cobalt and about 11 wt. % nickel.

TABLE I

| Steel Compositions in wt. % | | | | | | | | | |
|---|---|---|---|---|---|---|---|---|---|
| Alloy | C | Cr | Mo | W | V | Ni | Si | Co | Mn |
| 4340 | 0.38 | 0.9 | 0.25 | — | — | 1.8 | 0.3 | — | 0.7 |
| 300M | 0.38 | 0.9 | 0.3 | — | 0.08 | 1.8 | 0.3 | — | 0.5 |
| AerMet 100 | 0.23 | 3.1 | 1.2 | — | — | 11.1 | — | 13.4 | — |
| Ferrium M54 | 0.30 | 1.0 | 2.0 | 1.3 | 0.10 | 10.0 | — | 7.0 | — |
| H-11 | 0.40 | 5.0 | 1.3 | — | 0.5 | — | 1.0 | — | 0.5 |

SUMMARY OF THE DISCLOSURE

In one implementation, a steel alloy is provided. The steel alloy includes: a medium carbon secondary hardening steel composition containing: 0.3-0.45 wt. % carbon; 4-6 wt. % chromium; 0-2.5 wt. % molybdenum; 0-3 wt. % tungsten; 0-1.0 wt. % vanadium; less than 0.75 wt. % silicon; less than 3 wt. % cobalt; and less than 1 wt. % manganese; and an addition of nickel to the medium carbon secondary hardening steel composition in a wt. % that: increases a yield strength of the medium carbon secondary hardening steel composition to at least 1500 MPa; increases an ultimate tensile strength of the medium carbon secondary hardening steel composition to at least 1800 MPa; and increases a $K_{Ic}$ fracture toughness to at least about 86 MPa√m.

In another implementation, a method of making a steel alloy is provided. The method includes: vacuum induction melting a medium carbon secondary hardening steel composition with an addition of nickel; vacuum arc remelting the medium carbon secondary hardening steel composition with the addition of the nickel; following vacuum arc remelting, quenching the steel alloy to at least facilitate a phase transformation from austenite; refrigerating the steel alloy to reduce the amount of retained austenite; and tempering the steel alloy to reduce the amount of retained austenite.

DETAILED DESCRIPTION

There are many different types of secondary hardening steels. To achieve secondary hardening one needs carbon in the steel and alloying elements that are strong carbide formers. Strong carbide formers commonly used to precipitate alloy carbides and produce secondary hardening are molybdenum, chromium, tungsten, and vanadium. Secondary hardening is produced by tempering at high temperatures in the range of about 450° C. to 600° C. These high tempering temperatures are required because the atoms of chromium, molybdenum, tungsten, and vanadium diffuse slowly, and the high temperatures are required so that they can diffuse or move through the crystal structure to form the alloy carbides. The alloy carbides formed to provide secondary hardening would be $Cr_7C_3$, $Mo_2C$, $W_2C$, and VC. Chromium carbides themselves do not provide sufficient strengthening so almost all secondary hardening steels contain some molybdenum or tungsten in combination with some vanadium.

One common type of secondary hardening steels are the so-called "hot work die steels." A typical hot work die steel is the steel H-11. The composition of H-11 is given in Table I, above. This steel is much less highly alloyed than AerMet 100. This steel is called a hot work die steel because it is used in forming operations at temperatures on the order of 500° C. Because the alloy carbides are precipitated on tempering at high temperatures, these steels retain some strength up to high temperatures. However, hot work die steels exhibit a pronounced decrease in toughness after being tempered at temperatures that produce the peak secondary hardness. For this reason they are not used for applications where fracture toughness is an issue.

The present inventor has studied the effects of cobalt, silicon, aluminum, and nickel on the hardness and Charpy impact energy of a base hot work die steel. The compositions of the base steel and the modified alloys are given in Table II, below. The base composition was, in wt. %, 0.38C-4.5Cr-2Mo-0.5W-0.5V. To this, additions were made of 2 wt. % aluminum, 2 wt. % silicon, 4 wt. % nickel, 4 wt. % cobalt and 8 wt. % cobalt. These modified heats are the Base+2Al, Base+2Si, Base+4Ni, Base+4Co, and the Base+8Co. All alloying additions increase the hardness after tempering at 550° C. However, the Charpy impact energies of the heats containing additions of silicon, aluminum, and cobalt were relatively low. The Charpy impact energy of the Base+4Ni alloy was 32.3 J at a hardness of Rockwell-C of 54.3. This Charpy impact energy is not unusually high but it is a little better than 300M.

TABLE II

Compositions in wt. % of Alloys Used to Compare the Effects of Cobalt, Silicon, Aluminum, and Nickel on the Tempering Response of a Base Hot Work Die Steel

| Alloy | C | Cr | Mo | W | V | Ni | Al | Si | Co | $O_2$ | $N_2$ | S |
|---|---|---|---|---|---|---|---|---|---|---|---|---|
| Base | 0.38 | 4.4 | 2.0 | 0.49 | 0.43 | 0.005 | 0.008 | <0.1 | <0.1 | 0.0024 | 0.0027 | 0.0038 |
| Base + 4Ni | 0.39 | 4.2 | 2.1 | 0.50 | 0.50 | 4.4 | <0.1 | <0.1 | <0.1 | 0.0019 | 0.0026 | 0.0046 |
| Base + 2Al | 0.38 | 4.2 | 2.0 | 0.50 | 0.45 | <0.1 | 1.9 | <0.1 | <0.1 | 0.0013 | 0.0013 | 0.0058 |
| Base + 2Si | 0.40 | 4.2 | 1.9 | 0.51 | 0.46 | <0.1 | <0.1 | 1.85 | <0.1 | 0.0038 | 0.0045 | 0.0029 |
| Base + 4Co | 0.38 | 4.4 | 2.0 | 0.48 | 0.48 | <0.1 | <0.1 | <0.1 | 3.9 | 0.0026 | 0.0024 | 0.0032 |
| Base + 8Co | 0.38 | 4.3 | 2.0 | 0.49 | 0.49 | <0.1 | <0.1 | <0.1 | 7.7 | 0.0019 | 0.0018 | 0.0034 |

The phosphorous levels are all less than 0.010 wt. %.

In past work of the present inventor, and in other prior art described above, the combination of high strength, high fracture toughness, and resistance to corrosion was not achieved, with the exception of AeroMet 100. AeroMet 100 achieves these performance characteristics through the inclusion of cobalt, which adds significantly to the cost of the steel.

In one implementation of a steel alloy of the present disclosure, the composition may be substantially free of cobalt, and contain iron, carbon, nickel, chromium, molybdenum, and vanadium, and combinations thereof, while having a high fracture toughness, a slow Stage II crack propagation rate, and stress corrosion cracking toughness ($K_{ISCC}$) not typically associated with substantially cobalt-free, secondary hardening steel alloys.

Iron may be provided in a steel alloy from any of a variety of sources. Examples of iron sources include, but are not limited to, virgin iron produced from iron ore, recycled iron, recycled steel, other sources of iron known to those skilled in the art, and any combinations thereof. In one example, recycled iron or recycled steel, may be used in combination with any other source of iron.

Iron is present in a steel alloy of the present disclosure. In one example, iron is included in an amount from about 85 weight percent ("wt. %") to about 92 wt. %. In another example, iron is present in a range of about 87 wt. % to about 91 wt. %. In yet another example, iron is present in a range of about 89 wt. % to about 91 wt. %. In still another example, iron is present in a range of about 89 wt. % to about 90 wt. %.

Carbon is combined with iron to produce steel. Exemplary methods of combining carbon with iron include, but are not limited to, adding coal, coke, or other carbon source to molten iron. Other methods of combining carbon and iron are well known to those skilled in the art. In one exemplary aspect, carbon may change the physical and chemical properties of iron by remaining in solid solution with iron. In another exemplary aspect, carbon may change the physical and chemical properties of iron by reacting with alloying elements also present in iron.

Carbon is present in a steel alloy of the present disclosure. In one example, carbon is present in an amount of about 0.2 wt. % to about 0.5 wt. %. In another example, carbon is present in an amount of about 0.3 wt. % to about 0.4 wt. %. In yet another example, carbon may be present in an amount of about 0.35 wt. % to about 0.38 wt. %. In still yet another example, carbon may be present in an amount of about 0.38 wt. %.

Nickel is present in a steel alloy of the present disclosure. In one example, nickel is present in an amount of about 2 wt. % to about 4 wt. %. In another example, nickel is present in an amount of about 2.5 wt. % to about 4 wt. %. In yet another example, nickel is present in an amount of about 3 wt. % to about 4 wt. %. In still yet another example, nickel is present in an amount of about 3 wt. %. In another example, nickel is present in an amount of about 0.5 wt. % to about 3.5 wt. %. In yet another example, nickel is present in an amount of about 0.5 wt. % to about 4 wt. %. In still yet another example, nickel is present in an amount of about 4 wt. % to about 6 wt. %. In another example, nickel is present in an amount of about 3 wt. % to about 7 wt. %. In yet another example, nickel is present in an amount of at least 3 wt. %.

Chromium is present in a steel alloy of the present disclosure. In one example, chromium is present in an amount of about 4 wt. % to about 5.5 wt. %. In another example, chromium is present in an amount of about 4.2 wt. % to about 5 wt. %. In yet another example, chromium is present in an amount of about 4.5 wt. % to about 5 wt. %. In still yet another example, chromium is present in an amount of about 4.5 wt. %.

Molybdenum is present in a steel alloy of the present disclosure. In one example, molybdenum is present in an amount of about 1 wt. % to about 3.5 wt. %. In another example, molybdenum is present in an amount of about 1.9 wt. % to about 2.1 wt. %. In still yet another example, molybdenum is present in an amount of about 2 wt. %.

Vanadium is present in a steel alloy of the present disclosure. In one example, vanadium is present in an amount of about 0.4 wt. % to about 0.75 wt. %. In another example, vanadium is present in an amount of about 0.4 wt. % to about 0.5 wt. %. In still yet another example, vanadium is present in an amount of about 0.5 wt. %.

Tungsten is present in a steel alloy of the present disclosure. In one example, tungsten is present in an amount of about 0.1 wt. % to about 3 wt. %. In another example, tungsten is present in an amount of about 0.5 wt. % to about 2.5 wt. %. In still yet another example, tungsten is present in an amount of about 0.5 wt. %.

At least one rare earth element may be present in a steel alloy of the present disclosure. Rare earth elements include, but are not limited to, yttrium, cerium, lanthanum, scandium, and any combinations thereof. In one example, a rare earth element or elements may be added individually to a steel alloy. In one example, one or more rare earth elements are present in an amount up to about 0.1 wt. %. In another example, substantially no rare earth elements are present.

In yet another example, rare earth elements may be added by using a mixture of a plurality of rare earth elements commonly called "Mischmetal." In one example, Mischmetal can have lanthanum present in an amount of about 25 wt. % to about 35 wt. %, cerium present in an amount of about 45 wt. % to about 55 wt. %, praseodymium present in an amount of about 4 wt. % to about 7 wt. % and neodymium present in an amount of about 11 wt. % to about 17 wt. %. In another example, Mischmetal can have lanthanum present in an amount of about 30 wt. % to about 50 wt. %, cerium present in an amount of about 50 wt. % to about 70 wt. %, praseodymium present in an amount to about 0.5 wt. % and neodymium present in an amount to about 0.5 wt. %.

In still another example, rare earth elements can be supplied as an alloy with another alloying element including, but not limited to, nickel. The rare earth-nickel alloy can then be added to a steel alloy. Rare earth elements may be provided to perform various functions in the alloy including, but not limited to, gettering of impurities.

Titanium may also be present in a steel alloy of the present disclosure. In one example, titanium may be present in an amount of up to about 0.25 wt. %. In another example, substantially no titanium is present. Niobium may also be present in a steel alloy of the present disclosure. In one example, niobium is present in an amount up to about 0.50 wt. %. In another example, substantially no niobium is present.

In one example method that may be used to prepare a steel alloy of the present disclosure, the method includes melting the various components and/or raw materials used to accomplish the desired composition. Those skilled in the art will recognize from the present disclosure the amounts of components and/or raw materials needed to produce the desired composition having the makeup set forth herein. Melting the components may be accomplished by, for example, vacuum induction melting. Those skilled in the art will appreciate that many other methods of melting the components are possible. These other methods include, but are not limited to, vacuum-arc melting, electric arc furnace melting, and any combination thereof. After melting the components and permitting the components to partially or wholly solidify, the components are re-melted using, for example, vacuum-arc melting. Vacuum-arc melting may remove volatile impurities, byproducts, and gases resulting from the liquification of the components. Regardless of the melting process used, or the number of times the components are melted, gettering additives, as described above, may be added to a molten steel alloy. In another example, small additions of manganese (present in an amount of up to about 0.7 wt. %), titanium or niobium may be added to getter impurities (e.g., with or without rare earth element gettering agents).

After melting components, a steel alloy may be partly or wholly solidified. Solidification includes, but is not limited to, casting, forging, or other techniques well known in the art. After solidification, a steel alloy may be "austenitized." Austenitizing includes heating an alloy to a temperature, for example a temperature between 950° C. and 1300° C., for a period of time to facilitate the transformation of the alloy crystals from an austenite phase.

A steel alloy is quenched from a liquid or from a higher temperature solid to a lower temperature solid. In one exemplary aspect, quenching an alloy can cause the conversion of some austenite to martensite, although quenching is not limited only to this particular purpose or this particular phase transformation. Example quenching methods include, but are not limited to, immersion of a steel alloy into air (or other gas), oil, or water; exposing a steel alloy to a continuous flow of a heat-absorbing fluid; placing a steel alloy in contact with a solid-phase conductive heat sink, such as a copper form; removing the conducted heat from the heat sink using methods well known to those in the art; and any combinations thereof.

A steel alloy, when solidified, may optionally be refrigerated. In one exemplary aspect, refrigeration may further reduce the amount of austenite present. While not completely understood, reducing the amount of retained austenite may improve the strength of the steel. The reduction of the amount of austenite may also improve other physio-chemical properties, as is known to those skilled in the art. Refrigeration methods of quenched steels are well known in the art and may include refrigerants such as chilled air, a chilled fluid, a chilled liquid, dry ice or liquid nitrogen.

A steel alloy may be tempered. Tempering may change the distribution of stresses internal to a solidified alloy, induce formation of alloy precipitates, or produce other physio-chemical changes. In some examples, tempering to induce formation of alloy precipitates is sufficient to classify the steel as a "secondary hardening steel," explained below in more detail. Tempering methods are well known to those skilled in the art, and may include reheating the steel to any of a number of temperatures between about 200° C. to about 800° C.

In some example methods of preparing a steel alloy, a first cycle of quenching, refrigerating, and tempering may be repeated to further reduce the amount of austenite in the steel alloy or produce other physio-chemical changes.

Example One

One example of a steel alloy of the present disclosure was prepared according to the following procedure. Iron, carbon, chromium, molybdenum, tungsten, vanadium and nickel were combined into a 180 kg batch to produce a composition shown below in Table III and identified as Alloy "A". This composition is achieved by adding the appropriate raw materials in appropriate amounts using methods known to those skilled in the art. The elements used to form Alloy A were melted using vacuum induction melting. Mischmetal was added just before pouring the liquid steel prepared by vacuum induction melting. The nominal composition of the Mischmetal used 60 wt. % cerium, 36 wt. % lanthanum, 5 wt. % praseodymium, 0.2 wt. % neodymium, 0.3 wt. % iron, 0.04 wt. % silicon, and 0.2 wt. % magnesium. The batch was allowed to solidify and then was re-melted using vacuum-arc re-melting. The solid steel after the vacuum arc re-melting was hot worked into flat bar at an initial working temperature of 1150° C. Specimens were prepared in order to measure the mechanical properties of the steel. Preparation included heat treatment of the specimens. Specimen blanks were cut for tensile specimens, for Charpy impact specimens, for specimens to be used to measure the fracture toughness and for specimens to be used to assess resistance to stress corrosion cracking in salt water at room temperature.

Specimens from this batch were oil-quenched using oil at room temperature about 30° C. and then refrigerated overnight at about −196° C. using liquid nitrogen. Each specimen was tempered for about one hour at about the temperature shown in Table IV. The samples were water quenched upon removal from the tempering process using water at about 25° C., and then refrigerated in liquid nitrogen. The process of tempering, quenching, and refrigerating, as described above, was repeated three times to produce "triple tempered" samples.

The composition of Alloy "A" is presented below in Table III, as are prior art alloys. The prior art alloys shown are AISI Steel Grade 4340 (identified as "B"), Grade 300M (identified as "C"), AerMet 100® brand secondary hardening steel (identified as "D"), Ferrium M54® brand steel (identified as "E"), H11® brand steel (identified as "F"), and an alloy described in the scientific literature as "Base+Ni" (identified as "G") (The article describing alloy is entitled "A Comparison of the Effects of Cobalt, Silicon, Nickel, and Aluminum on the Tempering Response of a Medium Chromium Secondary Hardening Steel," ISIJ International, Vol. 46, No. 5 (2006).

TABLE III

| Alloy | C | Cr | Mo | W | V | Ni | Si | Co | Mn |
|---|---|---|---|---|---|---|---|---|---|
| A | 0.38 | 4.5 | 2.0 | 0.5 | 0.5 | 3.0 | 0 | 0 | 0 |
| B | 0.38 | 0.9 | 0.25 | 0 | 0 | 1.8 | 0.3 | 0 | 0.7 |
| C | 0.38 | 0.9 | 0.3 | 0 | 0.08 | 1.8 | 0.3 | 0 | 0.5 |
| D | 0.23 | 3.1 | 1.2 | 0 | 0 | 11.1 | 0 | 13.4 | 0 |
| E | 0.30 | 1.0 | 2.0 | 1.3 | 0.10 | 10.0 | 0 | 7.0 | 0 |
| F | 0.40 | 5.0 | 1.3 | 0 | 0.5 | 0 | 1.0 | 0 | 0.5 |
| G | 0.39 | 4.2 | 2.1 | 0.5 | 0.5 | 4.4 | <0.1 | <0.1 | 0.7 |

The mechanical properties of the four samples of Alloy A were tested using methods well known in the art. Specifically, the yield strength, ultimate tensile strength, Charpy Impact Energy, $K_{Ic}$ fracture toughness were tested. Yield strength and ultimate tensile strength were measured using the industry standard method described by ASTM E8/E8M-09 (3.01 Annual Book of ASTM Standards, Standard Test Methods for Tension Testing of Metallic Materials, at 65-91 (2010)). Charpy Impact Energy was measured using the industry standard method described by ASTM E23-07a (3.01 Annual Book of ASTM Standards, Standard Test Methods for Notched Bar Impact Testing of Metallic Materials, at 179-206 (2010)). Fracture toughness ($K_{Ic}$) was measured using the industry standard method described by ASTM E399-09 (3.01 Annual Book of ASTM Standards, Standard Test Methods for Linear-Elastic Plane-Strain Fracture Toughness $K_{Ic}$ of Metallic Materials, at 516-548 (2010)). Stress corrosion cracking resistance in salt water $K_{ISCC}$, and the resistance to Stage II crack growth were measured by the test commonly known in the art as the "slowly rising K method" of Professor Gangloff, developed at the University of Virginia as explained in "Comprehensive Structural Integrity-Environmentally Assisted Fracture", 2003, pp. 31-101 (Elsevier Ltd, Oxford, United Kingdom). Stage II crack growth may also be measured using a test used by Ritchie that is explained in "Effects of Silicon and Retained Austenite on Stress Corrosion Cracking Resistance in Ultrahigh Strength Steels", Metallurgical Transactions A, Vol. 9A, at 35-40 (1978). The foregoing test method explanations are incorporated by reference herein.

Table IV displays Alloys A's measured properties. The results of Alloy A are further categorized based on a tempering temperature applied to a sample. Properties of alloys B to G available in the literature are also presented.

TABLE IV

| Alloy (Tempering Condition) | Charpy Impact Energy (J) | $K_{Ic}$ (MPa√m) | Ultimate Tensile Strength (MPA) | Yield Strength (MPA) | Stage II Crack Growth Rate (nm/second) |
|---|---|---|---|---|---|
| A (Triple Tempered at 525° C.) | 25.2 | 109.6 | 1972 | 1510 | N/A |
| A (Triple Tempered at 550° C.) | 33.2 | 125.8 | 1931 | 1558 | N/A |
| A (Triple Tempered at 575° C.) | 34.2 | 145.1 | 1882 | 1586 | 30 |
| A (Triple Tempered at 575° C. and then Tempered for 10 Hours at 500° C.) | 35.6 | 143.6 | 1875 | 1586 | N/A |
| B | 30 | 84 | 1950 | 1620 | N/A |
| C | 25-30 | 66-77 | 1972-1986 | 1655-1689 | 1000 |
| D | 40.7 | 126.4 | 1965 | 1724 | 100 |
| E | N/A | 120.9 | 2027 | 1724 | N/A |
| F | 20 | 30-50 | 2005 | 1675 | N/A |
| G | 32.3 | N/A | 1930 | N/A | N/A |

Alloy A exhibits a $K_{Ic}$ fracture toughness typically associated with other alloys of steel having different compositions. For example, Alloy A, a secondary hardening steel as explained below, exhibits a $K_{Ic}$ between about 100 MPa√m and about 150 MPa√m. Alloy A also lacks cobalt in any substantial amount. In contrast, Alloys D and E, also both secondary hardening steels, each have a $K_{Ic}$ roughly comparable to that of Alloy A, but do include cobalt in substantial amounts.

Furthermore, Alloy A exhibits a $K_{Ic}$ fracture toughness typically associated with alloys of steel that exhibit different mechanical properties. For example, those skilled in the art will appreciate that $K_{Ic}$ is roughly correlated to Charpy Impact Energy. That is, generally a low Charpy Impact energy correlates to a low $K_{Ic}$ and a high Charpy Impact Energy correlates to a high $K_{Ic}$. However, contrary to this expected result, Alloy A exhibits a Charpy Impact Energy that would not be expected to be correlated to a $K_{Ic}$ as high as about 150 MPa√m. For example, Alloy D exhibits a Charpy Impact Energy nearly 20% higher than that of Alloy A, and yet Alloy A exhibits a comparable, if not higher, $K_{Ic}$.

Alloy F (a/k/a "H-11") is a medium carbon secondary hardening steel. Alloy A is secondary hardening steel. Those skilled in the art will appreciated that the Charpy Impact Energy of Alloy F is on the order of 20 J. The fracture toughness of this alloy, which does not contain cobalt, is on the order of 50 MPa√m, even though it has a strength in the range of the strengths exhibited by Alloy A.

Even further, Alloy A exhibits mechanical properties not known to be attained by the other alloys listed in Table III. For example, the Stage II crack growth rate of Alloy A is about 3% of the rate exhibited by Alloy D, a low alloy steel lacking cobalt, and about 30% of the rate exhibited by Alloy D, a secondary hardening steel that includes cobalt.

As mentioned above, Alloy A may be classified generally as a secondary hardening steel. Secondary hardening steels have, among other physical properties, a high hardness (for example, above 45 Rockwell C) that develops upon tempering in a range of about 450° C. to about 600° C. By tempering the steel in this temperature range, it is believed that chemical element components such as molybdenum, chromium, tungsten, and vanadium react with carbon to form precipitates, often referred to as "alloy carbides." Examples of the alloy precipitates believed to be formed include, but are not limited to, $Cr_2C_3$, $Mo_2C$, $W_2C$, and VC. While not fully understood, it is believed that these precipitates interfere with deformation mechanisms, for example acting as dislocation pinning sites, thereby increasing the strength of the steel.

Example Two

Three heats were made to examine the effect of nickel content on the mechanical properties of a base steel having a composition in wt. % of 0.38C-4.5Cr-2.0Mo-0.5W-0.5V. All heats were made by vacuum induction melting followed by vacuum arc remelting. The base heat was heat 011301, which contained no nickel. Three other heats were made: heat 011164 contained 3 wt. % nickel; heat 011291 contained 5 wt. % nickel; and heat 011481 contained 6 wt. % nickel. The compositions of the four heats are given in Table V.

TABLE V

Compositions of Experimental Secondary Hardening Steels (values in wt. %)

| Heat | C | Cr | Mo | W | V | Ni |
|---|---|---|---|---|---|---|
| 011301(0Ni) | 0.38 | 4.5 | 2.0 | 0.5 | 0.5 | 0.0 |
| 011164(3Ni) | 0.38 | 4.5 | 2.0 | 0.5 | 0.5 | 3.0 |
| 011291(5Ni) | 0.38 | 4.5 | 2.0 | 0.5 | 0.5 | 5.0 |
| 011481(6Ni) | 0.38 | 4.5 | 2.0 | 0.5 | 0.5 | 6.0 |

The effects of austenitizing temperature, tempering temperature, and the quench rate from the austenitizing temperature (oil quenching vs. air-cooling) on tensile properties and the Charpy energy were examined. The tensile properties and Charpy impact energies were measured for the four heats after austenitizing at 1050° C. and triple tempering at 525° C., 550° C., and 575° C. after oil quenching (Table VI) and after air-cooling (Table VII). The effect of quench rate from the austenitizing temperature on fracture toughness was not examined in all cases. While fracture toughness results were obtained for all four heats for all three tempering temperatures after air-cooling from the austenitizing temperature, the fracture toughness results were only obtained for the heat with 3 wt. % nickel (011164) for oil quenching from the austenitizing temperature. The results for oil quenching are given in Table VI and the results for the case of air cooling from the austenitizing temperature are given in Table VII.

TABLE VI

Effect of Nickel Content and Tempering Temperature on Mechanical Properties Oil-quenched from the Austenitizing Temperature of 1050° C. and Triple Tempered

| Tempering Temperature | Heat | Yield Strength (MPa) | Ultimate Tensile Strength (MPa) | Reduction in Area of a Tensile Specimen (%) | Charpy Energy (J) | $K_{IC}$ (MPa√m) |
|---|---|---|---|---|---|---|
| 525° C. | 011301(0Ni) | 1650 | 1919 | 33 | 13.8 | — |
| | 011164(3Ni) | 1510 | 1972 | 55 | 25.2 | 109.5 |
| | 011291(5Ni) | 1675 | 2045 | 60 | 31.4 | — |
| 550° C. | 011301(0Ni) | 1550 | 1875 | 66 | 15.0 | — |
| | 011164(3Ni) | 1558 | 1931 | 48 | 33.2 | 125.8 |
| | 011291(5Ni) | 1607 | 1974 | 60 | 40.9 | — |
| 575° C. | 011301(0Ni) | 1521 | 1850 | 59 | — | — |
| | 011164(3Ni) | 1586 | 1882 | 65 | 34.2 | 145.1 |
| | 011291(5Ni) | 1522 | 1820 | 43 | 35.4 | — |

The mechanical properties given in Tables VI and VII illustrate the fact that after triple tempering at 550° C. and oil quenching or air-cooling from the austenitizing temperature, the strength increases as the nickel content increases. Also, it can be observed from Tables VI and VII that Charpy impact energy can in some instances be increased by increasing the nickel content in an alloy. Moreover, increasing the nickel to 5 wt. % results in a higher Charpy impact energy for oil-quenching from the austenitizing temperature than for air-cooling after tempering at 550° C. As shown in Table VII, a good combination of strength and Charpy toughness was obtained when the nickel content was 5 wt. % and when air-cooling from the austenitizing temperature is used and triple tempering is performed at 550° C. Thus, these results show that increasing the nickel content from 3 to 5 wt. % can lead to much improved mechanical properties. Therefore, it is concluded that in the development of these new, lower-cost, ultra-high strength steels of high fracture toughness, increasing the nickel content to 5 wt. % or more can lead to much improved mechanical properties.

TABLE VII

Effect of Nickel Content and Tempering Temperature on Mechanical Properties Air-cooled from the Austenitizing Temperature of 1050° C. and Triple Tempered

| Tempering Temperature | Heat | Yield Strength (MPa) | Ultimate Tensile Strength (MPa) | Reduction in Area of a Tensile Specimen (%) | Charpy Energy (J) | $K_{IC}$ (MPa√m) |
|---|---|---|---|---|---|---|
| 525° C. | 011301(0Ni) | 1637 | 2056 | 38 | 4.1 | 28.8 |
| | 011164(3Ni) | 1580 | 1991 | 44 | 21.7 | 97.1 |
| | 011291(5Ni) | 1628 | 2082 | 48 | 28.2 | 86.1 |
| | 011481(6Ni) | 1643 | 2072 | 43 | 25.1 | 91.6 |
| 550° C. | 011301(0Ni) | 1573 | 1953 | 47 | 5.1 | 29.4 |
| | 011164(3Ni) | 1606 | 1976 | 54 | 22.8 | 108.3 |
| | 011291(5Ni) | 1636 | 2014 | 57 | 26.9 | 104.9 |
| | 011481(6Ni) | 1631 | 1977 | 45 | 23.8 | 113.8 |
| 575° C. | 011301(0Ni) | 1510 | 1846 | 52 | 8.7 | 31.6 |
| | 011164(3Ni) | 1566 | 1871 | 48 | 25.1 | 119.3 |
| | 011291(5Ni) | 1532 | 1820 | 43 | 20.7 | 111.1 |
| | 011481(6Ni) | 1533 | 2045 | 29 | 21.1 | 113.0 |

Nickel additions in excess of 3 wt. % can significantly improve the strength and toughness, especially after air-cooling from the austenitizing temperature. Nickel additions in excess of 5 wt. % may continue to increase the strength and the toughness as well for some alloys. However, if the nickel additions are too high, the martensite start temperature of the steel will become too low, which results in too much retained austenite. As such, there may be a maximum amount of nickel that could be used in these steels without compromising one or more mechanical properties; this maximum amount may correspond to about 7 wt. %. As indicated by Table VI and Table VII, nickel additions can separately or simultaneously enable one or more of: yield strengths of at least 1500 MPa, ultimate tensile strengths of at least 1800 MPa, and a $K_{Ic}$ fracture toughness to at least about 86 MPa√m. In some embodiments, nickel additions can separately or simultaneously enable one or more of: yield strengths of at least 1700 MPa and ultimate tensile strengths of at least 1900 MPa. In some embodiments, nickel additions can enable a $K_{Ic}$ fracture toughness to at least about 100 MPa√m In one aspect, the foregoing description can be expressed as being directed to creating a high-strength, high-toughness steel alloy by adding nickel to medium carbon secondary hardening steels having compositions in wt. % in the ranges of 0.3-0.45C, 4-6Cr, 0-2.5Mo, 0-3W, 0-1.0V and having relatively small amounts of silicon (less than 0.75 wt. %), cobalt (less than 3 wt. %), and manganese (less than 1 wt. %). Nickel additions to such medium carbon secondary hardening steel greater than 0 wt. %, and particularly at least 3 wt. % are especially useful in achieving high strength and high fracture toughness.

While the present disclosure qualifies measurements and quantities with the term "about," it is contemplated that additional examples using the same quantitative values also exist within the scope of this disclosure without the qualifier "about." For example, the amount of niobium present in an alloy can be 0.50 wt. %.

Exemplary examples have been disclosed above and illustrated in the accompanying drawings. It will be understood by those skilled in the art that various changes, omissions and additions may be made to that which is specifically disclosed herein without departing from the spirit and scope of the present invention.

What is claimed is:

1. A steel alloy, comprising:

a medium carbon secondary hardening steel composition containing:

0.3-0.45 wt. % carbon;

4-6 wt. % chromium;

0-2.5 wt. % molybdenum;

0-3 wt. % tungsten;

0-1.0 wt. % vanadium;

less than 0.75 wt. % silicon;

less than 3 wt. % cobalt; and less than 1 wt. % manganese; and an addition of nickel to the medium carbon secondary hardening steel composition in a range of about 3 wt. % to about 7 wt. % that:

provides a V-notch Charpy energy of at least 20.7 joules;

increases a yield strength of the medium carbon secondary hardening steel composition to at least 1500 MPa;

increases an ultimate tensile strength of the medium carbon secondary hardening steel composition to at least 1800 MPa; and increases a $K_{Ic}$ fracture toughness of the medium carbon secondary hardening steel to at least about 86 MPa√m.

2. The steel alloy according to claim 1, wherein the addition of nickel is in a range of about 4 wt. % to about 6 wt. %.

3. The steel alloy according to claim 1, wherein the addition of nickel is in a range of about 3 wt. % to about 4 wt. %.

4. The steel alloy according to claim 1, wherein the addition of nickel is in a range of about 5 wt. % to about 3.5 wt. %.

5. The steel alloy according to claim 1, wherein the yield strength is at least 1700 MPa and the ultimate tensile strength is at least 1900 MPa.

6. The steel alloy according to claim 1, wherein the $K_{Ic}$ fracture toughness is at least 100 MPa√m.

7. The steel alloy according to claim 1, wherein the wt. % cobalt is less than about 0.05%.

8. The steel alloy according to claim 1, wherein the medium carbon secondary hardening steel contains:

about 0.38 wt. % carbon;

about 4.5 wt. % chromium;
about 2.0 wt. % molybdenum;
about 0.0 wt. % tungsten;
about 0.5 wt. % manganese and
about 0.5 wt. % vanadium.

9. The steel alloy according to claim 8, wherein the addition of nickel is in a range of 0.5 wt. % to 4 wt. %.

10. The steel alloy according to claim 8, wherein the addition of nickel is in a range of 0.5 wt. % to 3.5 wt. %.

11. The steel alloy according to claim 1, wherein the medium carbon secondary hardening steel contains:
about 0.40 wt. % carbon;
about 5.0 wt. % chromium;
about 1.3 wt. % molybdenum;
about 0.5 wt. % tungsten; and
about 0.5 wt. % vanadium.

12. The steel alloy according to claim 11, wherein the addition of nickel is in a range of about 3 wt. % to 4 wt. %.

13. The steel alloy according to claim 11, wherein the addition of nickel is in a range of 3 wt. % to 3.5 wt. %.

14. A method of making the steel alloy of claim 1, comprising:
vacuum induction melting the medium carbon secondary hardening steel composition with the addition of the nickel;
vacuum arc remelting the medium carbon secondary hardening steel composition with the addition of the nickel;
following vacuum arc remelting, quenching the steel alloy to at least facilitate a phase transformation from austenite;
refrigerating the steel alloy to reduce the amount of retained austenite; and
tempering the steel alloy to reduce the amount of retained austenite.

* * * * *